US010672221B2

(12) United States Patent
Jackson et al.

(10) Patent No.: US 10,672,221 B2
(45) Date of Patent: Jun. 2, 2020

(54) GAMING TABLE

(71) Applicant: TCS John Huxley Europe Limited, London (GB)

(72) Inventors: Harley David Jackson, Wheeler Heights (AU); Simon McLaren Witty, Artarmon (AU); Emanuel Maniatis, Artarmon (AU)

(73) Assignee: TCS John Huxley Europe Limited, London (GB)

( * ) Notice: Subject to any disclaimer, the term of this patent is extended or adjusted under 35 U.S.C. 154(b) by 0 days.

(21) Appl. No.: 14/773,809

(22) PCT Filed: Feb. 28, 2014

(86) PCT No.: PCT/GB2014/000071
§ 371 (c)(1),
(2) Date: Sep. 9, 2015

(87) PCT Pub. No.: WO2014/140512
PCT Pub. Date: Sep. 18, 2014

(65) Prior Publication Data

US 2016/0012662 A1 Jan. 14, 2016

(30) Foreign Application Priority Data

Mar. 12, 2013 (GB) ..... 1304455.7

(51) Int. Cl.
*G07F 17/32* (2006.01)

(52) U.S. Cl.
CPC ..... *G07F 17/322* (2013.01); *G07F 17/3211* (2013.01)

(58) Field of Classification Search
CPC ..... G07F 17/322; G07F 17/3211
(Continued)

(56) References Cited

U.S. PATENT DOCUMENTS 4,843,568 A * 6/1989 Krueger ..... G06F 3/011 345/632
4,862,925 A * 9/1989 Motta ..... D03C 7/06 139/419

(Continued)

FOREIGN PATENT DOCUMENTS

EP 1 818 087 A1 * 11/2005 ..... A63F 13/08
JP 2009086577 4/2009

(Continued)

OTHER PUBLICATIONS

International Search Report from PCT Patent Application No. PCT/GB20141000071, dated Jun. 6, 2014, 4 pages.

(Continued)

*Primary Examiner* — David L Lewis
*Assistant Examiner* — Matthew D Hoel
(74) *Attorney, Agent, or Firm* — Shumaker & Seiffert, P.A.

(57) ABSTRACT

There is described a gaming table (3) having a playing surface (9) in which a display panel (6) is positioned below the playing surface of the gaming table, and is operable to display moving and/or still images which can be viewed through the playing surface by players at the table. A diffuser screen 8 may be placed between the playing surface (9) and the display panel (6). If the upper surface of the display panel (6) is uneven, a cover sheet 16 may be placed over the display panel (6) to provide a smooth substrate for the diffuser screen (8) and/or the playing surface (9). Embodiments are described in which a projector projects an image onto the undersurface of a screen mounted below the playing surface so that the image is visible through the playing surface.

15 Claims, 5 Drawing Sheets

(58) Field of Classification Search
USPC ..... 273/309, 148 R
See application file for complete search history.

(56) References Cited

U.S. PATENT DOCUMENTS 5,441,279 A * 8/1995 Messina ..... A47B 37/00 273/309
5,649,997 A * 7/1997 Cavallero ..... B08B 15/00 131/238
5,965,907 A * 10/1999 Huang ..... G02F 1/133603 257/103
6,027,115 A * 2/2000 Griswold ..... G07F 17/3211 273/143 R
6,366,016 B1 * 4/2002 Sakaguchi ..... H01L 27/3211 313/502
7,234,702 B2 * 6/2007 Lipscomb ..... A47B 25/00 273/274
7,446,827 B2 11/2008 Ko et al.
7,623,115 B2 * 11/2009 Marks ..... G06F 3/017 345/156
7,628,701 B2 * 12/2009 Wells ..... G07F 17/32 341/23
7,682,034 B2 3/2010 Asvadi et al.
7,682,249 B2 * 3/2010 Winans ..... G07F 17/32 345/45
7,760,193 B2 * 7/2010 Yee ..... G06F 3/0425 345/175
7,811,170 B2 * 10/2010 Winans ..... G07F 17/32 345/30
7,893,953 B2 * 2/2011 Krestakos ..... H04N 7/15 348/14.01
7,936,338 B2 * 5/2011 Iwase ..... G06F 3/0418 345/173
8,125,578 B2 * 2/2012 Choi ..... G09G 3/002 348/40
8,357,033 B2 * 1/2013 Williams ..... G07F 17/3211 463/20
8,480,091 B1 * 7/2013 Florence ..... A63F 3/00157 273/309
8,545,328 B2 * 10/2013 Miller ..... A63F 1/18 273/138.1
8,684,360 B2 * 4/2014 van Linden ..... A63F 1/067 273/309
8,690,382 B2 * 4/2014 Farmer ..... F21V 5/00 362/223
8,743,077 B1 * 6/2014 Sprague ..... G06F 1/1643 345/1.1
8,754,426 B2 * 6/2014 Marx ..... F21K 9/00 257/88
8,758,144 B2 * 6/2014 Williams ..... G02F 1/133602 463/46
8,803,836 B2 * 8/2014 Ookawara ..... G06F 3/047 345/173
8,827,487 B2 * 9/2014 Farmer ..... F21V 5/00 362/223
8,864,567 B2 * 10/2014 Underdahl ..... G07F 17/32 273/274
8,896,444 B1 * 11/2014 Knust ..... G07F 17/322 340/332
8,961,298 B2 * 2/2015 Czyzewski ..... G07F 17/3204 463/25
9,142,084 B2 * 9/2015 Kelly ..... G07F 17/322
9,249,939 B2 * 2/2016 Farmer ..... F21V 5/00
9,336,643 B2 * 5/2016 Witty ..... G07F 17/32
9,478,099 B2 * 10/2016 Czyzewski ..... G07F 17/3225
9,536,379 B2 * 1/2017 Czyzewski ..... G07F 17/3204
9,613,488 B2 * 4/2017 Kelly ..... G07F 17/322
9,734,481 B2 * 8/2017 Emori ..... G06K 7/10039
10,008,070 B2 * 6/2018 Nordahl ..... G07F 17/32
2001/0039904 A1 * 11/2001 Moore ..... A47B 13/12 108/59
2002/0002072 A1 * 1/2002 Sines ..... A63F 3/00157 463/12
2002/0126499 A1 * 9/2002 Bender ..... A47B 13/12 362/551
2002/0173354 A1 * 11/2002 Winans ..... G07F 17/32 463/20
2004/0070149 A1 * 4/2004 Lipscomb ..... A47B 25/00 273/309
2004/0207597 A1 * 10/2004 Marks ..... G06F 3/017 345/156
2005/0049049 A1 3/2005 Griswold et al.
2005/0093241 A1 * 5/2005 Lipscomb ..... A47B 25/00 273/309
2005/0282623 A1 * 12/2005 Matsuno ..... A63F 13/00 463/25
2006/0087865 A1 4/2006 Ha et al.
2006/0207139 A1 * 9/2006 Deflin ..... G09F 13/22 40/544
2007/0093290 A1 * 4/2007 Winans ..... G07F 17/32 463/30
2007/0157856 A1 7/2007 Skoog et al.
2008/0094353 A1 * 4/2008 Marks ..... G06F 3/017 345/156
2008/0111310 A1 * 5/2008 Parvanta ..... A63D 15/00 273/309
2008/0132332 A1 * 6/2008 Pryor ..... A63F 13/00 463/31
2008/0217855 A1 * 9/2008 Sloan ..... A63F 1/00 273/292
2008/0248852 A1 * 10/2008 Rasmussen ..... G07F 17/3211 463/16
2009/0082079 A1 * 3/2009 Kuhn ..... G07F 17/32 463/13
2009/0124321 A1 * 5/2009 Gadda ..... G07F 17/3202 463/16
2009/0143141 A1 6/2009 Wells et al.
2009/0302533 A1 * 12/2009 Smith ..... A63F 7/0668 273/108.1
2010/0105475 A1 * 4/2010 Mikhailov ..... A63F 13/06 463/33
2010/0130280 A1 5/2010 Arezina et al.
2010/0279757 A1 * 11/2010 Glenn, II ..... G07F 17/3211 463/17
2010/0311489 A1 * 12/2010 Miller ..... A63F 1/12 463/16
2010/0311494 A1 * 12/2010 Miller ..... A63F 1/18 463/22
2011/0086708 A1 * 4/2011 Zalewski ..... G06F 3/017 463/36
2011/0111840 A1 * 5/2011 Gagner ..... G07F 17/32 463/25
2011/0118031 A1 * 5/2011 Mao ..... G06F 3/017 463/37
2011/0298751 A1 * 12/2011 Merel ..... G02F 1/133308 345/175
2012/0064970 A1 * 3/2012 Drewry ..... A63F 13/12 463/30
2012/0122559 A1 * 5/2012 Kelly ..... G07F 17/322 463/25
2012/0184367 A1 * 7/2012 Parrott ..... G06F 1/163 463/31
2013/0044337 A1 * 2/2013 Yoshida ..... A63F 13/00 358/1.9
2014/0370980 A1 * 12/2014 Czyzewski ..... G07F 17/3211 463/31
2015/0018083 A1 * 1/2015 Czyzewski ..... G07F 17/3225 463/25
2016/0071367 A1 * 3/2016 Litman ..... G07F 17/3232 463/25
2017/0018137 A1 * 1/2017 Kugler et al. ..... G07F 17/3206
2017/0039799 A1 * 2/2017 Czyzewski ..... G07F 17/3225
2017/0206739 A1 * 7/2017 Kelly ..... G07F 17/3251
2017/0356810 A1 * 12/2017 Fukuzawa ..... G01L 9/005

FOREIGN PATENT DOCUMENTS

JP 2009086577 A 4/2009
WO 0016863 A1 3/2000

(56) References Cited

FOREIGN PATENT DOCUMENTS

| | | | | |
|---|---|---|---|---|
| WO | 2000016863 | | 3/2000 | |
| WO | WO200210809 | | 2/2002 | |
| WO | WO2004100111 | | 11/2004 | |
| WO | WO 2008/039666 | A2 * | 4/2008 | ..... A63F 9/24 |
| WO | WO 2009/061614 | A1 * | 5/2009 | ..... G07F 17/32 |

OTHER PUBLICATIONS

New Zealand Intellectual Property Office Examination Report for IP No. 712854 dated Nov. 6, 2018, 3 pages.
New Zealand Intellectual Property Office Examination Report for IP No. 712854 dated Feb. 20, 2019, 3 pages.
New Zealand First Examination Report for IP No. 751160 dated Oct. 23, 2019, 3 pages.
Examination Report from counterpart New Zealand Application No. 751160, dated Jan. 23, 2020, 4 pp.

* cited by examiner

GAMING TABLE

CROSS-REFERENCE TO RELATED APPLICATIONS

This application is a national stage entry under 35 U.S.C. § 371 of International Application No. PCT/GB2014/000071, filed Feb. 28, 2014, published in English, which claims the benefit of priority of Great Britain Patent Application No. 1304455.7, filed Mar. 12, 2013, all of which are hereby incorporated by reference herein in their entirety.

The present invention relates to gaming tables, and is primarily concerned with gaming tables for dice games and roulette games, but is also applicable to gaming tables for card games, etc.

The most popular casino dice games are craps and Sic Bo. A craps table is generally provided with a cloth playing surface onto which the dice are thrown. A part of the cloth is marked out as a betting area, in which areas are delineated representing different wagers available to the players. Players place chips in one or more of these delineated areas to represent their wager or wagers.

In conventional Sic Bo tables, a hard playing surface or a felt gaming cloth is provided, with markings to delineate areas in which players may place wagers in the form of chips. The table may be provided with an automatic dice shaker, in which dice are contained beneath a transparent dome and are shaken by an automated actuator on command. The dome may be covered by an opaque shield, which is removed and replaced by the croupier during play.

In some hard-topped gaming tables, a "lightbox" is used to illuminate a particular betting area to indicate winning bets. In such tables, betting areas of the playing surface have positioned beneath them a respective lightbox coextensive with the betting area. A lamp within the lightbox can be lit to shine light upward through the playing surface so as to illuminate that betting area. The walls surrounding the lightbox are opaque, to prevent diffusion of the light from causing neighbouring areas to be illuminated when the lamp is lit. Lamps may be flashed sequentially or randomly to indicate various phases of the game such as 'place bets'.

The present invention seeks to provide an illuminated gaming table which provides for the display of more complex moving images on the betting and playing surfaces of the table. The table surface may be formed from cloth, such as textile, felt or baize material, or from a hard material such as acrylic plastic (e.g., perspex®) or glass.

The table includes an imaging device which can project light through the table surface to display images on the playing surface. In a preferred embodiment, a controllable display panel is mounted beneath the table surface. The display panel may be controllable to show animated sequences of images or other moving displays. The moving images may move around the playing areas, the betting areas, or in all parts of the table surface.

In an alternative embodiment, the imaging device may be a projector which projects a moving image onto a screen placed beneath the table surface or on to the underside of the table surface, so that the image is visible through the table surface.

The selection and display of animated images may be controlled so as to be synchronised with gaming or other events at the table or elsewhere.

An embodiment of the present invention will now be described in detail with reference to the accompanying drawings, in which.

Figure 1:
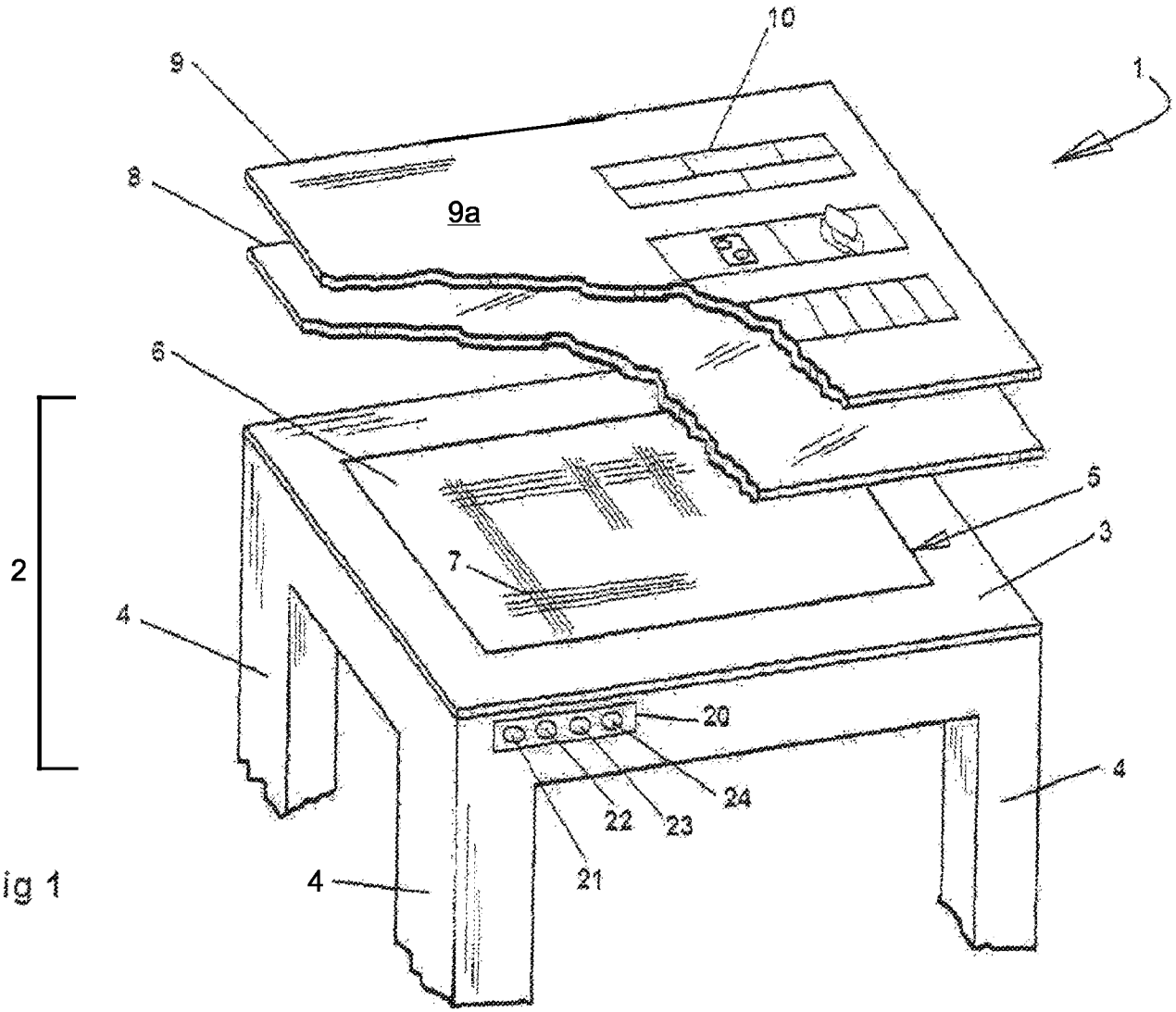
FIG. 1 is a schematic exploded view of a gaming table according to an embodiment of the invention.
Figure 2:
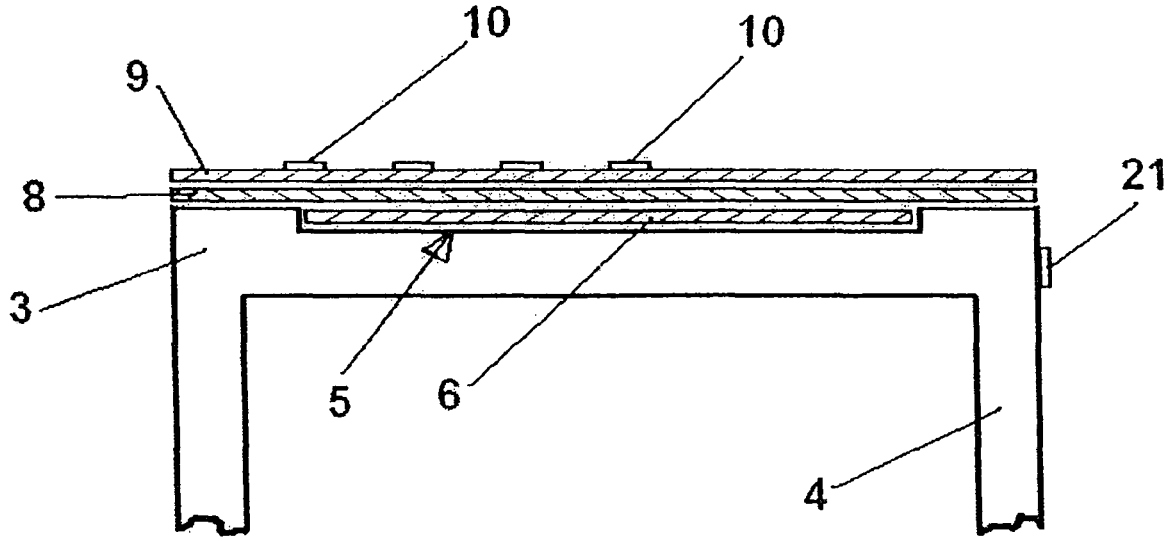
FIG. 2 is a sectional view taken in the plane 2-2 of FIG. 1.

Referring to FIGS. 1 and 2, FIG. 1 illustrates a gaming table 1 comprising a table base 2. The table base 2 has a generally planar horizontal top 3 supported by legs 4.

The tabletop 3 has a central recess 5, into which is set an LED display panel 6. The LED display panel 6 is composed of a multitude of LEDs 7, individually controllable so as to act as a number of individual pixels. The LED display panel 6 is shown with a smooth upper surface. In practice, a separate upper layer overlying the LEDs may be used to achieve the smooth upper surface.

Overlying the tabletop 3 and LED display panel 6 in FIGS. 1 and 2 is a translucent layer of a resilient synthetic plastics foam material which acts as a diffuser screen 8, and preferably extends over the entire tabletop 3 to provide a smooth continuous surface. The foam material is preferably from 1 mm to 10 mm in thickness, to provide adequate diffusion with minimal light bleed into adjacent cells.

Applied to the upper surface of the translucent diffuser screen 8 is a cloth 9, which forms the playing surface and betting surface of the table. The cloth 9 may be a standard polyester cloth as is conventionally used in gaming tables.

The conventional cloth 9, overlying the foam diffuser layer 8 has tactile playing surface characteristics which are substantially the same as a standard gaming table. The foam diffuser layer acts to blend the light from the individual LEDs of the display panel and also provides a soft feel to the cloth 9.

If the upper surface of the display panel 6 is uneven, a clear Perspex cover is provided over the LEDs to create an even upper surface.

The tabletop 3 is provided with a control panel 20, with a number of control input buttons 21 to 24. These are used by the croupier in charge of the table to control the operation of the display panel 6, as will be described below.

The upper surface of the cloth may be formed with printed lines 10 to delineate playing or betting areas on the cloth.

FIG. 2 is a sectional view of the table of FIG. 1, showing the tabletop 3 supported on legs 4, with the recess 5 in the upper surface of the tabletop 3 accommodating the LED display panel 6. Diffuser screen 8 overlies the tabletop 3 and LED display screen 6, while the cloth 9 extends over the upper surface of the diffuser screen 8. The printed lines 10 on the upper surface of the cloth 9 are exaggerated, for clarity.

The LEDs 7 of the display panel 6 may be controlled to display animated or still images on the display panel 6, or simply to display areas of colour, abstract patterns, geometric shapes etc. The sharpness of the individual LEDs is softened by the translucent diffuser screen 8, and the brightness of the LEDs is such that the image can be seen through the cloth 9 and the diffuser screen 8 by players surrounding the table.

Figure 2A:
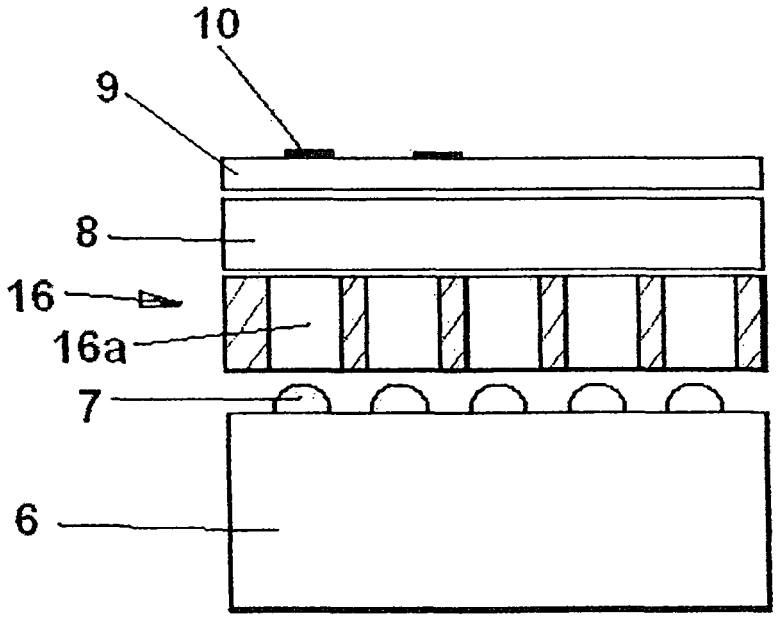
FIG. 2*a* is an enlarged sectional view of a display panel and overlying components of the gaming table of FIG. 1.

FIG. 2*a* is a sectional view illustrating an LED display panel 6 from the upper surface of which a number of LEDs 7 protrude. The upper surface of the display panel 6 is thus not smooth. To provide a smooth substrate for the diffuser layer 8 a cover sheet 16 overlies the display panel 6. The cover sheet 16 may be a clear sheet of Perspex, or may be formed from an opaque material. When this type of display panel and cover sheet 16 is used in the table 3 of FIG. 2, the recess 5 in the tabletop 3 will be dimensioned so as to accommodate the display panel 6 and the cover sheet 16 with the upper surface of the cover sheet 16 flush with the remainder of the tabletop 3 to provide a smooth continuous surface for the diffuser layer 8 and the cloth 9.

If the upper surface of the display panel 6 is sufficiently smooth, then the cover layer 16 may be omitted.

In alternative embodiments, such as tables for Sic Bo, the playing surface may be a hard light-transmitting layer formed for example from transparent or translucent glass or Perspex material. If the playing surface is a layer of transparent material, then a diffuser screen may be placed beneath the playing surface, and the animated images may be projected onto or displayed against the undersurface of the diffuser screen. If the playing surface is a layer of translucent material, the playing surface itself may act as a diffuser screen and the moving images may be projected or displayed directly onto the underside of the playing surface layer.

Figure 3:
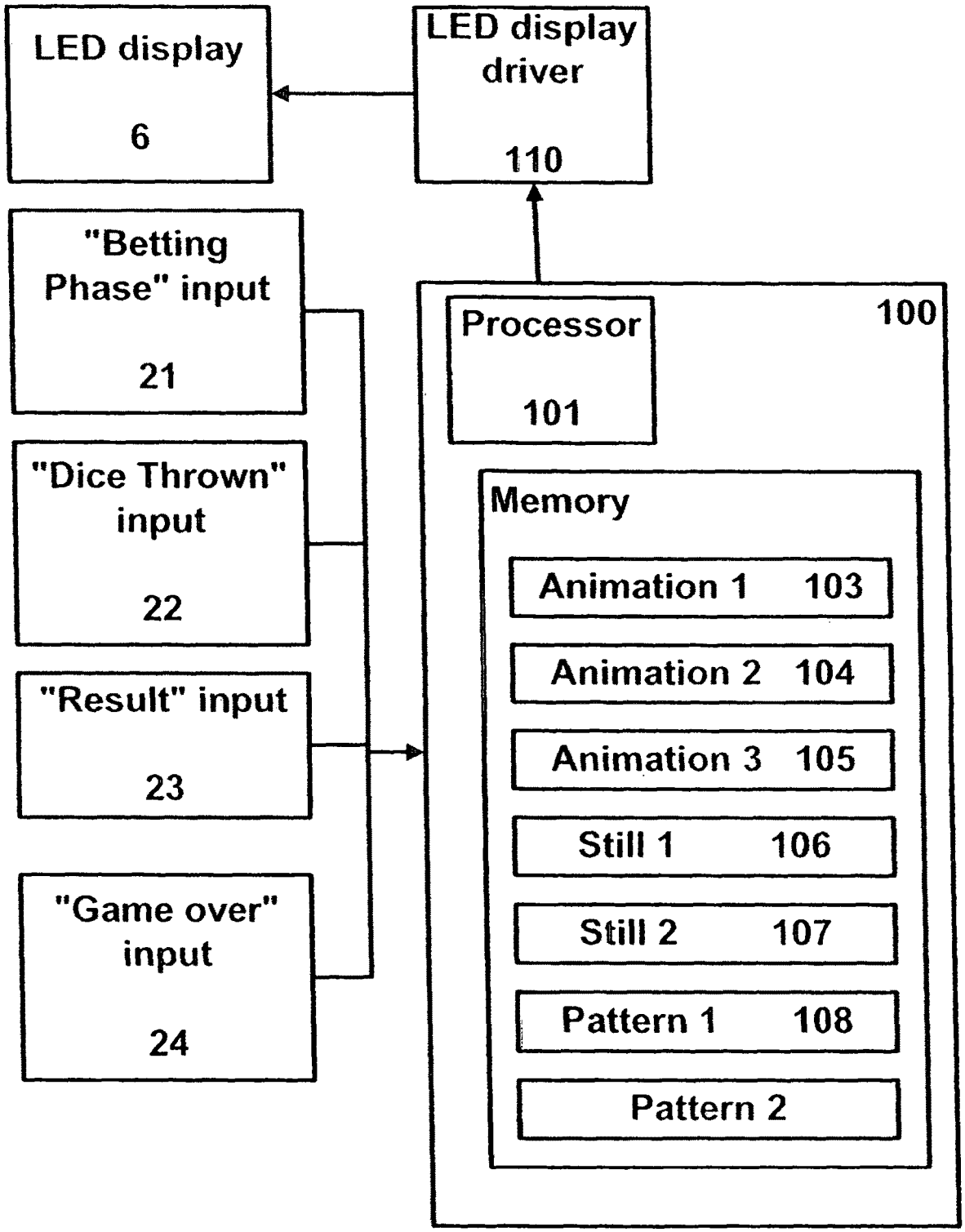
FIG. 3 is a schematic diagram of a gaming table display and control system.

FIG. 3 schematically illustrates a control system for controlling the display of the gaming table.

The control system comprises a control unit 100 comprising a processor 101 and a memory 102. Stored in the memory 102 are video animation sequences 103, 104, 105, each of which corresponds to an animation sequence required to be shown during a stage of play of the game for which the table is intended. The memory 102 may also store a number of still images 106, 107, and/or a number of abstract patterns 108.

The control system further comprises an LED display driver 110 under control of the control unit 100, which in turn sends appropriate signals to the LED display 6 to display the required images and/or patterns.

Linked to the control unit 100 are a number of inputs 21 to 24, by which different events in a game may be signalled to the processor 101.

In the present example, the table is intended for a dice game where each game comprises five elements, namely:

1. an initial betting phase during which players place their bets on the betting regions marked out by the markings 10 on the cloth 9;
2. a dice throwing event in which to dice are thrown;
3. a result determining event in which the result of the throw of the dice is determined;
4. a wager resolution phase during which wagers placed by the players are resolved, either by being returned, forfeit or by having winnings added to them; and
5. a "game end" event signifying that all bets placed on that game have been resolved and betting is now open for the next game.

At the start of play, the croupier in charge of the table may make a "Betting Phase" input, for example by operating an input button 21 marked "Betting" to signify that the initial betting phase has begun. In response to the "Betting Phase" input, the processor 101 may select a first animation sequence 103 from the memory 102, and send control signals to the LED display driver 110 so that the animation sequence is shown on the LED display and is visible to the players through the cloth 9.

The memory 102 may store a number of different animation sequences intended to be played during the betting phase of the game, and may store instructions for the processor 101 to select content to be displayed following each input from the croupier. During the betting phase of the game, the processor may select an animation either at random or sequentially from a number of stored animation sequences appropriate to this phase of the game. The animation sequence played during the betting phase may consist of images of real or mythical creatures, or events such as tumbling dice or flames, and these may be visible beneath the betting area and/or the playing area of the table. The animation sequence played during the betting phase may be of a predetermined duration, and the conclusion of the animation sequence may signal to the croupier and to the players that the betting phase is over. Animation sequences of different lengths may be stored, and the processor may select an animation sequence on the basis of, for example, the time of day or the number of players present at the table.

When all players have placed their bets, the dice are thrown and the croupier makes a second input by pressing input button 22 marked "Throw" to indicate that the dice have been thrown. Alternatively, in a game where an automatic dice shaker is used, operation of the dice shaker to throw the dice causes the input indicating that the dice have been thrown This "Dice Thrown" input is received by the processor 101, which may then select a different animation sequence from the stored sequences in memory 102, and send signals to the display driver so that the LED display changes from the first sequence to the new animation sequence while the dice are thrown and settle. Again, the duration of this animation sequence may be arranged to correspond with an average or with the longest expected length of time taken for the dice to settle.

When the dice have settled the croupier will read the numbers on the dice, and make an input using the "Result" input 23, to signify to the processor 101 what the result of the throw was. For a game using two dice, the "Result" input 23 may consist of an array of six input buttons numbered in sequence from 1 to 6. To indicate a dice roll of 4, 3, the button 4 is pressed, followed by button 3 (or button 3 is pressed, followed by button 4). Alternatively, the result input 23 may consist of an array of twelve input buttons, numbered in two sequences of 1 to 6, to correspond with the possible results of the dice throw. For example, if the result of the throw was that one die showed a 4 and the other showed a 3, the croupier could press the number 4 from the first sequence of 6, and the number 3 from the second sequence of 6.

The "Result" input is then sent to the processor 101 which may select from the memory 102 a further animation sequence to be sent to the display driver and shown on the LED display 6. This animation sequence may indicate the result, for example by using an image of a creature or a pattern which moves around the table and finally settles beneath the betting area or areas which correspond to winning bets. The selection of the animation sequence to be shown in response to the "Result" input may therefore depend on the result of the dice throw.

The croupier then resolves all of the wagers placed for that game, and when this process is complete operates a "Game over" input to signify the conclusion of that game and the opening of the betting phase for the next game.

The "game over" input is received by the processor 101, which then selects an animation, still or pattern stored in the memory 102 which is appropriate to the betting phase, and sends it to the display driver 110 to be shown on the display 6.

Although the gaming table illustrated in FIGS. 1 and 2 and described above has been described in terms of its use in a dice game, it is possible to use the playing table for roulette games, Big Wheel games or card games. When used for card games, the betting areas 11 at one end of the table may be used for delineating regions where chips may be placed by players to mark their wager, and a clear area 9*a* at the other end of the table may be used for dealing cards to the players. The table need not be rectangular in shape, but could be semicircular or kidney shape to accommodate players of card games. The control panel 20 will be sited so as to be convenient for easy operation by the croupier or dealer in charge of the table.

Figure 4:
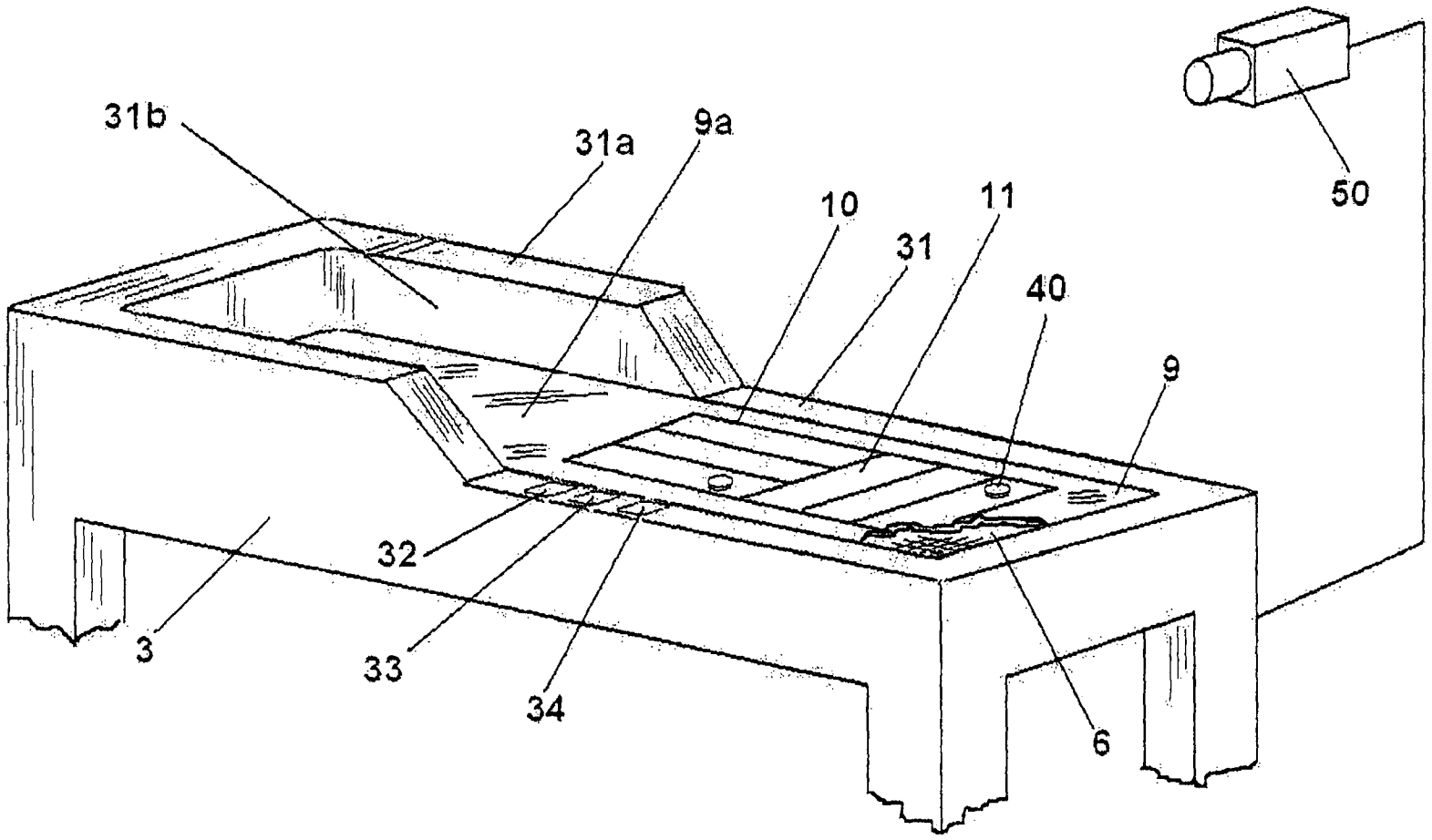
FIG. 4 is a perspective view of a gaming table according to a second embodiment of the invention, adapted for the playing of dice games.

FIG. 4 is a perspective view of an alternative embodiment of the invention, intended for dice games, for example "Craps", "Sic Bo" or other dice games.

The table shown in FIG. 4 has a tabletop 3 whose central region is covered by a cloth 9. An edge region 31 of the table surrounds the cloth 9, the edge region being raised at 31*a* to provide three walls 31*b* partially enclosing one end 9*a* of the cloth 9. The enclosed area 9*a* is a playing area into which dice may be thrown and contained by the walls 31*b*.

Extending beneath the entire extent of the cloth 9 is a display panel, on which images, still pictures and/or patterns may be displayed as play progresses. A corner region of the cloth 9 is shown cutaway, in order to show the display panel 6. In this embodiment, the display panel has a smooth upper surface, no diffuser screen is used and the cloth 9 lies directly on the upper surface of the display panel 6. The smooth upper surface of the display panel is able to provide the required smooth surface beneath the cloth to give a satisfactory playing surface.

At the unenclosed end of the table, the cloth 9 is provided with markings 10 which delineate betting regions 11 on which players may place bets on the outcome of the game.

The display panel 6 beneath the cloth 9 of the table is controlled by a similar control system as described above in relation to FIG. 3.

In this embodiment, one or more input means in the form of touch-screen devices 32, 33, 34 are provided in the surround 31 of the table for the croupier to make the appropriate control inputs for the LED display panel mounted beneath the cloth 9. The input options presented to the croupier may change during each phase of the game, for example during the betting phase the touch-screen display 32 may simply show a prompt for the croupier to make the "Dice Thrown" input by touching the screen as the dice are thrown. When all of the players have placed their chips 40 on the required betting areas 11, the dice are thrown and the croupier touches the screen to make the "Dice Thrown" input. Alternatively, in a game where an automatic dice shaker is used, operation of the dice shaker to throw the dice may cause the input indicating that the dice have been thrown.

The input means may comprise a plurality of touch-screen devices or a single touch-screen device, displaying a plurality of control buttons for the croupier to press. Advantageously, the buttons are arranged so that the croupier only has 2 make one contact with the touch-screen to signify the appropriate input to the control system. For example, the touch-screen display may have a button marked "Dice Thrown" for the croupier to press when or as the dice are thrown.

When this input is made, the touch-screen display may change to present the croupier with images of dice, so that the croupier may simply touch the images to indicate the result of the throw. If two dice are being used, the touch-screen display may show twelve images, respectively representing the 6 sides of 2 dice, so that the croupier may touch the two relevant images to indicate the result of the throw. Alternatively, the display may show only one set of six dice images, and the croupier may touch one of the images twice if the two dice come up with the same number. In accordance with the input made, the processor as before may select a particular animation or pattern to be displayed by the display panel 6 through the cloth 9, to indicate the result of the throw to the players.

The touch-screen display may then change to a prompt to the croupier to make the "Game over" input when all wagers have been resolved, and this input when received by the processor may cause it to select a different animation or pattern for display on the panel 6.

An image capture device such as a video camera 50 may be linked to the control system for the display panel 6. The camera 50 maybe directed at players around the table, so that images captured by the camera may be selectively displayed on the display panel and seen by the players through the cloth 9. The selection of video images to be displayed on the display panel 6 may be controlled by the touch-screen devices 32, 33, 34 operated by the croupier, or may be controlled remotely.

Figure 5:
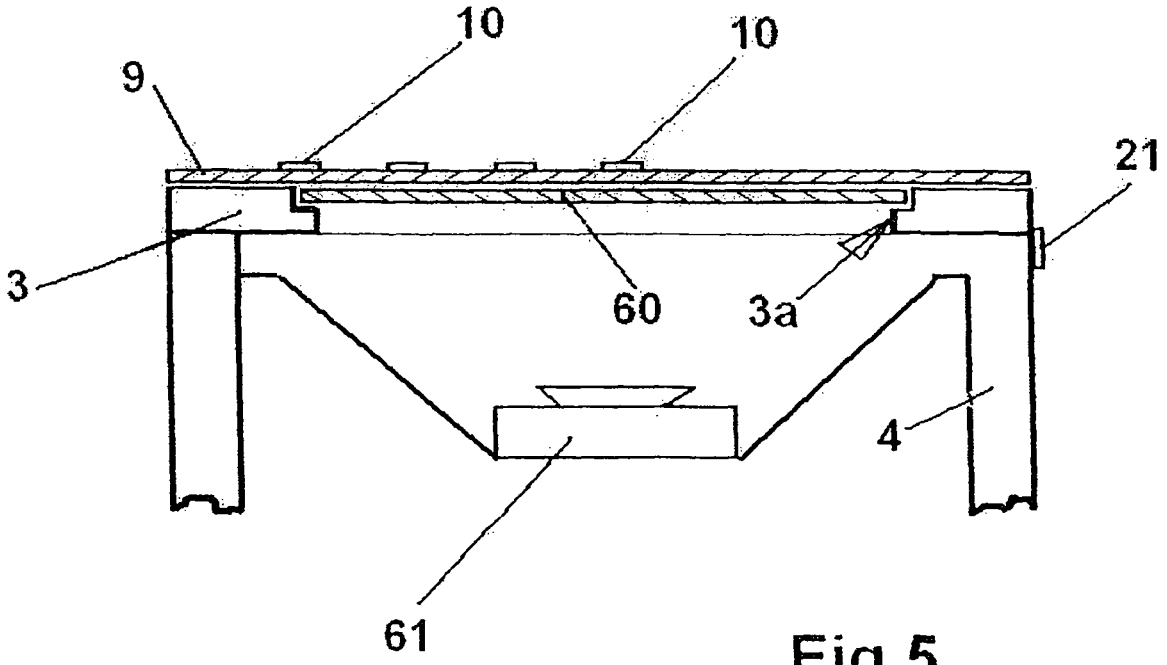
FIG. 5 is a sectional view similar to FIG. 2 of a gaming table according to a third embodiment of the invention.

FIG. 5 illustrates a third embodiment of a gaming table according to the invention. FIG. 5 is a view similar to FIG. 2, and corresponding parts are given like reference numbers. In FIG. 5, the gaming table has a tabletop 3 and legs 4. A central region of the tabletop is cutaway to form an opening 3*a*, and a projection screen 60 is mounted in the opening, the upper surface of the screen being flush with the upper surface of the tabletop 3. A cloth playing surface 9 extends over the tabletop 3 and the screen 60, with markings 10 on the cloth delineating betting areas, etc.

Beneath the projection screen 60 there is mounted a projector 61 for projecting images onto the undersurface of the screen 60. The screen 60 is of transparent or translucent material, such that images projected onto the screen 60 are visible from above through the cloth 9.

The projector 61 may be controlled by a control system similar to that described in relation to FIG. 3, with the display panel replaced by the projector 61 and the display panel driver replaced by a suitable driver circuit for the projector 61.

In a variant of the embodiment shown in FIG. 5, the top of the table may be formed from a hard transparent or translucent material and the images projected directly onto the undersurface of the tabletop so as to be visible from above.

ALTERNATIVE EMBODIMENTS

Although the diffusion layer 8 has been described as being a layer of foam material, it is foreseen that a solid layer of translucent material such as coloured Perspex or frosted glass may be used as the diffusion layer.

The display of images may not be controlled by the croupier at the table, but may be controlled remotely. The various phases of game play may be detected, for example by analysing video images of the table taken from cameras placed around and/or above the table, or by sensors placed on or about the table, and appropriate control inputs may be applied to the display by a remote control means receiving input from the sensors or cameras when different phases of the game are detected. In essence, any manual or automatic input could trigger a new animation sequence. For example, the movement of the roulette dolly (the marker used by the croupier to mark the winning number) in a roulette game or the drawing of a card from a card shoe in a card game could trigger a new animation sequence.

In other embodiments, control inputs to the display may be made for example by automatic dice shaking equipment, or by sensors set in gaming equipment such as roulette wheels or in the table itself such as a detector to detect the placing of a bet on the betting region of the table. For example, on a Sic Bo table where an automatic dice shaker is used, an image capture device may capture an image of the shaken dice and derive the result of the throw by image processing means. This result may be fed as an input of the processor of the control system, which may select an animation to display on the basis of the detected result.

The images displayed on the display panel 6 may be pre-stored video sequences, or alternatively may be live feeds, for example from cameras placed to capture images of players at the table. Images of, for example, winning players may be shown on the display panel 6 in order to encourage participation. As a further alternative, video images showing events remote from the table, such as sports games or reports, may be shown on the display panel 6.

The above embodiments have been described as comprising a display panel which, in the case of the embodiment depicted in FIGS. 1, 2 and 2*a*, is an LED display panel. Other types of display panel may be used, such as display panels used in flat panel television screens (e.g., volatile flat panel displays such as plasma display panels, liquid crystal display panels), provided that the display panel can provide images at sufficient brightness and clarity to be visible to the players through the table surface, e.g. through the cloth and through any diffusion layer between the display panel and the cloth.

The invention claimed is:

1. A gaming table comprising:

a table surface comprising at least one of a textile material, a felt material, or a baize material;

a light emitting diode (LED) illuminated display panel comprising a plurality of LEDs, the LED illuminated display panel mounted in a recess beneath the table surface, the LED illuminated display panel configured to display one or more images, wherein the one or more images are visible through the table surface;

a plurality of control inputs, each control input corresponding to a respective event in a table game played at the gaming table, and each control input configured to cause the LED illuminated display panel to display a respective animation sequence; and a diffuser screen mounted over the plurality of LEDs of the LED illuminated display panel to blend light emitted by the plurality of LEDs of the LED illuminated display panel.

2. The gaming table of claim 1, wherein the table surface comprises one or more regions.

3. The gaming table of claim 1, further comprising a cover sheet positioned between the LED illuminated display panel and the diffuser screen.

4. The gaming table of claim 1, wherein the diffuser screen comprises a synthetic foam material.

5. The gaming table of claim 1, further comprising a cover sheet positioned between the LED illuminated display panel and the diffuser screen to provide a smooth surface underlying the diffuser screen.

6. The gaming table of claim 1, wherein the diffuser screen is formed from a synthetic foam material.

7. The gaming table of claim 1, further comprising a projector arranged to project an image from below the table surface.

8. The gaming table of claim 1, wherein the table surface comprises a cloth supported on a horizontal transparent screen or a horizontal translucent screen, and wherein a projector is arranged to project an image onto an undersurface of the horizontal transparent screen or the horizontal translucent screen.

9. A gaming table system comprising:

a gaming table comprising:

a table surface comprising at least one of a textile material, a felt material, or a baize material;

a light emitting diode (LED) illuminated display panel comprising a plurality of LEDs, the LED illuminated display panel positioned in a recess beneath the table surface, the LED illuminated display panel configured to display one or more images, wherein the one or more images are visible through the table surface;

a diffuser screen mounted over the plurality of LEDs of the LED illuminated display panel to blend light emitted by the plurality of LEDs of the LED illuminated display panel;

a plurality of control inputs: each control input corresponding to a respective event in a table game played at the gaming table, and each control input configured to generate a respective input signal and cause the LED illuminated display panel to display a respective animation sequence; and a control unit to receive the respective input signal and control the LED illuminated display panel to display the respective animation sequence.

10. The gaming table system of claim 9, wherein the control unit comprises:

a memory to store the animation sequences; and a processor operable to:

receive the input signal from the control input;

select the respective animation sequence, and cause the animation sequence to be displayed on the LED illuminated display panel.

11. The gaming table system of claim 10, further comprising an image capture device operable to provide one or more images to the control unit.

12. The gaming table system of claim 9, wherein the control unit receives one or more input signals from at least one remote device to control the display of images.

13. The gaming table system of claim 12, wherein the remote device comprises at least one of an automatic dice shaker, a roulette wheel, or a card dealing shoe.

14. The gaming table system of claim 9, wherein images are displayed on a display panel mounted beneath the table surface.

15. The gaming table system of claim 9, wherein images are projected onto a screen mounted beneath the table surface.

* * * * *